US006231151B1

(12) United States Patent
Hotomi et al.

(10) Patent No.: US 6,231,151 B1
(45) Date of Patent: May 15, 2001

(54) DRIVING APPARATUS FOR INKJET RECORDING APPARATUS AND METHOD FOR DRIVING INKJET HEAD

(75) Inventors: Hideo Hotomi, Nishinomiya; Shoichi Minato, Sakai, both of (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/141,503

(22) Filed: Aug. 28, 1998

Related U.S. Application Data

(63) Continuation-in-part of application No. 08/965,016, filed on Nov. 5, 1997, now Pat. No. 6,089,690.

(30) Foreign Application Priority Data

Feb. 14, 1997 (JP) ..... 9-030625
Sep. 11, 1997 (JP) ..... 9-246716

(51) Int. Cl.[7] ..... B41J 29/38
(52) U.S. Cl. ..... 347/11; 347/68; 347/74
(58) Field of Search ..... 347/11, 68, 74

(56) References Cited

U.S. PATENT DOCUMENTS

| | | | | |
|---|---|---|---|---|
| 3,946,398 | | 3/1976 | Kyser et al. | 347/70 |
| 4,369,455 | | 1/1983 | McConica et al. | 347/11 |
| 4,393,388 | | 7/1983 | Matsuda et al. | 347/18 |
| 4,424,520 | | 1/1984 | Matsuda et al. | 347/11 |
| 4,491,851 | | 1/1985 | Mizuno et al. | 347/11 |
| 4,523,200 | | 6/1985 | Howkins | 347/11 |
| 4,686,539 | | 8/1987 | Schmidle et al. | 347/15 |
| 5,138,333 | | 8/1992 | Bartky et al. | 347/11 |
| 5,202,659 | * | 4/1993 | DeBonte et al. | 347/11 |
| 5,204,695 | * | 4/1993 | Tokunaga et al. | 347/11 |
| 5,781,203 | | 7/1998 | Uria et al. | 347/9 |
| 5,903,286 | | 5/1999 | Takahashi | 347/11 |

* cited by examiner

*Primary Examiner*—N. Le
*Assistant Examiner*—Shih-Wen Hsieh
(74) *Attorney, Agent, or Firm*—Sidley & Austin

(57) ABSTRACT

An inkjet printer according to the present invention records images by expelling ink droplets by applying a pulse voltage to a piezoelectric element for driving the same. In the inkjet printer, the waveform of a pulse voltage applied to the piezoelectric element consists of a rising portion of voltage having a first inclination relative to time and a failing portion having a second inclination. As a result, an inkjet printer permitting the picture quality to be improved can be provided.

16 Claims, 13 Drawing Sheets

3

WAVEFORM A

WAVEFORM B

WAVEFORM C

DRIVING APPARATUS FOR INKJET RECORDING APPARATUS AND METHOD FOR DRIVING INKJET HEAD

RELATED APPLICATIONS

This a continuation-in-part of U.S. patent application Ser. No. 08/965,016, now U.S. Pat. No. 6,089,690 which was filed on Nov. 5, 1997 and which claimed priority rights to Japanese patent Application 9-030625. This application claims priority rights to Japanese Patent Application Nos. 9-030625 and 9-246716, the contents of which are incorporated herein by reference.

BACKGROUND OF THE INVENTION

1. Field of the Invention

The present invention relates generally to inkjet recording apparatuses, and more particularly, to an inkjet recording apparatus for recording images by expelling ink droplets using a piezoelectric element.

2. Description of the Related Art

Among conventional inkjet printers, some known printers use a piezoelectric element (PZT) for the head. In such a head, a pulse voltage corresponding to image information is applied to the piezoelectric element, and distortion caused by the applied pulse voltage pressurizes ink in a prescribed container (ink channel), which causes ink droplets to be expelled form the nozzle provided at the ink channel toward a recording sheet. A rectangular pulse is conventionally known as the kind of pulse voltage applied to such a piezoelectric element.

FIG. 19 is a waveform chart showing rectangular pulse voltages as conventionally used. In these pulse voltages, the rising time, duration of the pulse amplitude, falling time, size of the pulse amplitude or the like is adjusted to control the speed, size or the like of droplets to be expelled.

The use of such a rectangular pulse voltage however may cause ripples in the pressure applied to ink caused by the vibration of the piezoelectric element for the duration of the pulse amplitude (voltage hold period).

FIG. 20 is an illustration of a narrowed part of an expelled ink produced by the vibration of the piezoelectric element during the voltage hold period. FIG. 21 is an illustration of ink droplets produced by the expelled ink having a narrowed part.

As shown in FIG. 20, an ink pillar 200 having narrow parts 201, 202 and 203 is produced from a nozzle 150 by applying a pulse voltage having a voltage hold period as shown in FIG. 19. An ink droplet 251 with satellites 252 and 253 is produced as shown in FIG. 21. Images formed on a sheet by such droplets are considerably degraded because satellites 252 and 253 stick at unexpected positions or the dot size becomes unstable by change in the volume of ink droplet 251.

SUMMARY OF THE INVENTION

It is therefore an object of the present invention to provide a method of expelling ink in an inkjet recording apparatus capable of forming high definition images.

Another object of the invention is to provide a driver for an inkjet head capable of high speed and high definition printing.

The above objects of the invention are achieved in an inkjet recording apparatus for expelling an ink droplet using a piezoelectric element by a method for expelling the ink droplet. The method includes the following steps of:

(a) outputting a drive pulse voltage from a driver to the piezoelectric element, the drive pulse voltage having a waveform consisting of a plurality of ramps;

(b) applying an energy produced by the piezoelectric element in response to the drive pulse voltage to an ink channel in which ink is filled; and (c) expelling an ink droplet from the ink channel in response to the applied energy.

According to another aspect of the invention, a driver for driving inkjet head which expels an ink droplet filled in an ink channel in response to an energy produced by a piezoelectric element, the driver outputting a drive pulse voltage to the piezoelectric element to produce the energy, the drive pulse voltage having a waveform consisting of a plurality of ramps.

The waveform of the drive pulse voltage applied to the piezoelectric element is set so as to consist of a plurality of ramps. For example, the drive pulse voltage may have a triangular waveform, a sawtooth waveform, or the like. Thus, the generation of satellites and the associated instability of the dot size as experienced in the conventional art may be prevented, which contributes to improvement in picture quality.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An inkjet printer according to embodiments of the invention will be now described in conjunction with the accompanying drawings.

Figure 1:
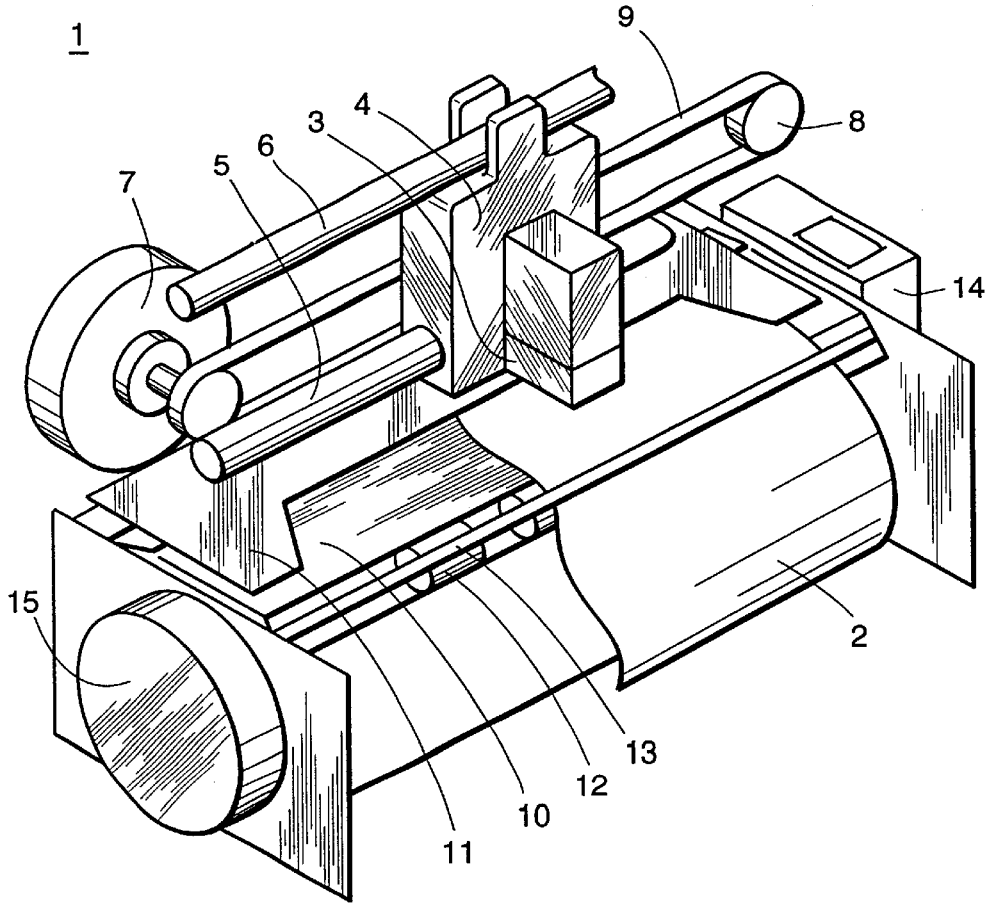
FIG. 1 is a perspective view schematically showing the structure of an inkjet printer according to a first embodiment of the invention.

Referring to FIG. 1, inkjet printer 1 includes a printer head 3 of an inkjet type, a carriage 4 for carrying printer head 3, swinging shafts 5 and 6 for reciprocating carriage 4 in parallel to the recording surface of a recording sheet 2, i.e., a recording medium such as paper and OHP sheet, a driving motor 7 for driving carriage 4 to reciprocate along swinging shaft shafts 5 and 6, a timing belt 9 for converting the revolution of driving motor 7 into the reciprocating movement of the carriage, and an idle pulley 8.

Inkjet printer 1 further includes a platen 10 also serving as a guide plate to guide recording sheet 2 along a transport path, a sheet pressing plate 11 for preventing recording sheet 2 on platen 10 from rising, a discharge roller 12 to discharge recording sheet 2, a spur roller 13, a recovering system 14 for cleaning the nozzle surface to eject ink in printer head 3, thereby returning an ink expelling fault to a normal state, and a paper feeding knob 15 for manually transporting recording sheet 2.

Recording sheet 2 is fed manually or by the function of a paper feeding device such as a cut sheet feeder into the recording unit in which printer head 3 and platen 10 oppose each other. During the time, the amount of revolution of the paper feeding roller which is not shown is controlled to control the transportation into the recording unit.

A piezoelectric element (PZT) is used for printer head 3 as an energy generator for expelling ink. The piezoelectric element is supplied with voltage and distorted. The distortion changes the volume of the channel filled with the ink. The change in the volume causes the ink to be expelled from the nozzle provided at the channel, and data is recorded onto recording sheet 2.

Carriage 4 scans recording sheet 2 in a main scanning direction (in the direction of transversely crossing recording sheet 2) by the function of driving motor 7, idle pulley 8, and timing belt 9, and printer head 3 attached at carriage 4 records images for one line. Every time the recording of one line completes, recording sheet 2 is sent in a sub scanning direction (the lengthwise direction) and then the next line is recorded.

Images are thus recorded onto recording sheet 2, which, after passed through the recording unit, is discharged by discharge roller 12 disposed on the downstream side in the transporting direction and spur roller 13 in abutment under pressure against roller 12 under pressure.

Figure 2:
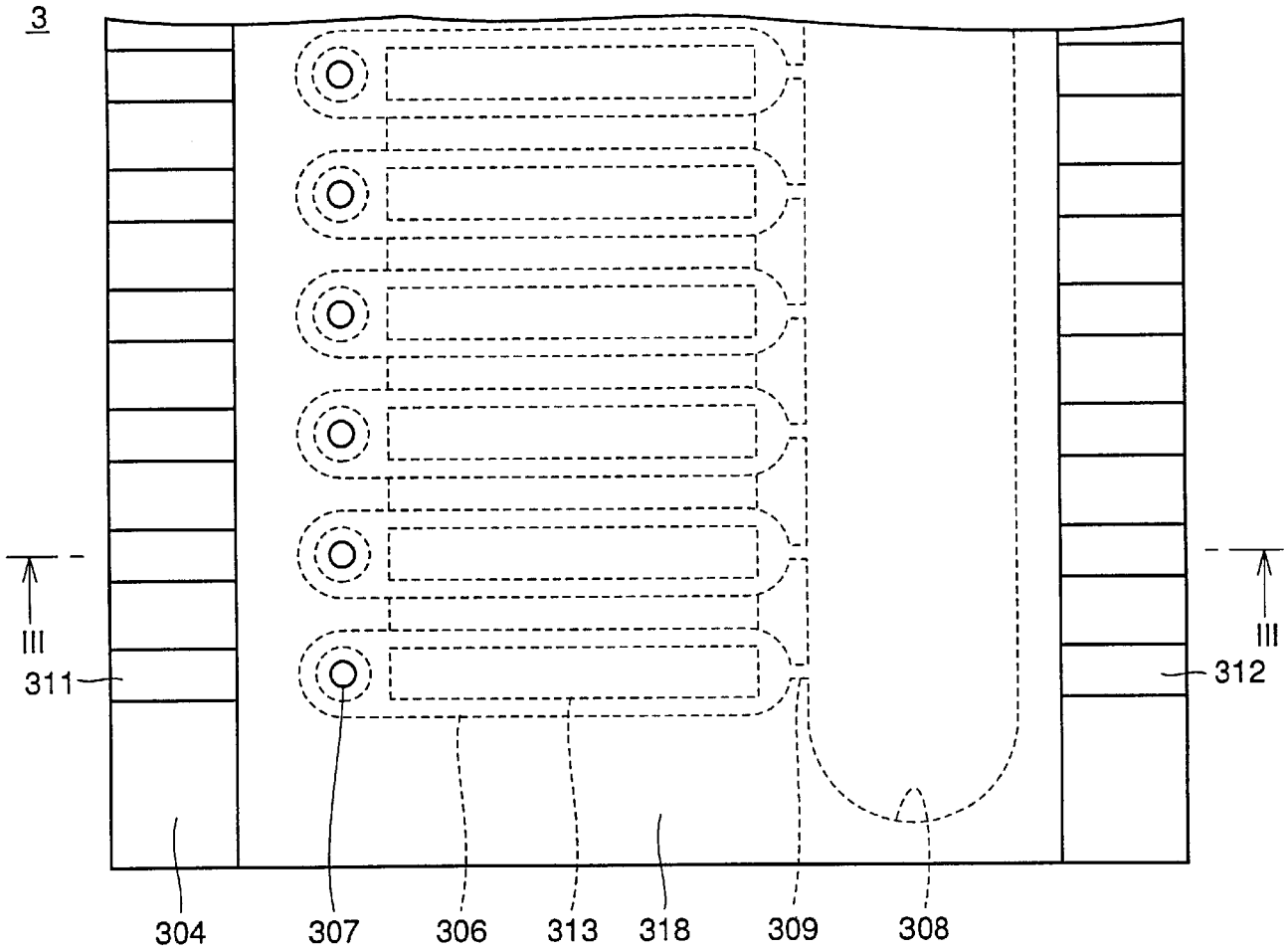
FIG. 2 is a plan view for use in illustration of the structure of the printer head.
Figure 3:
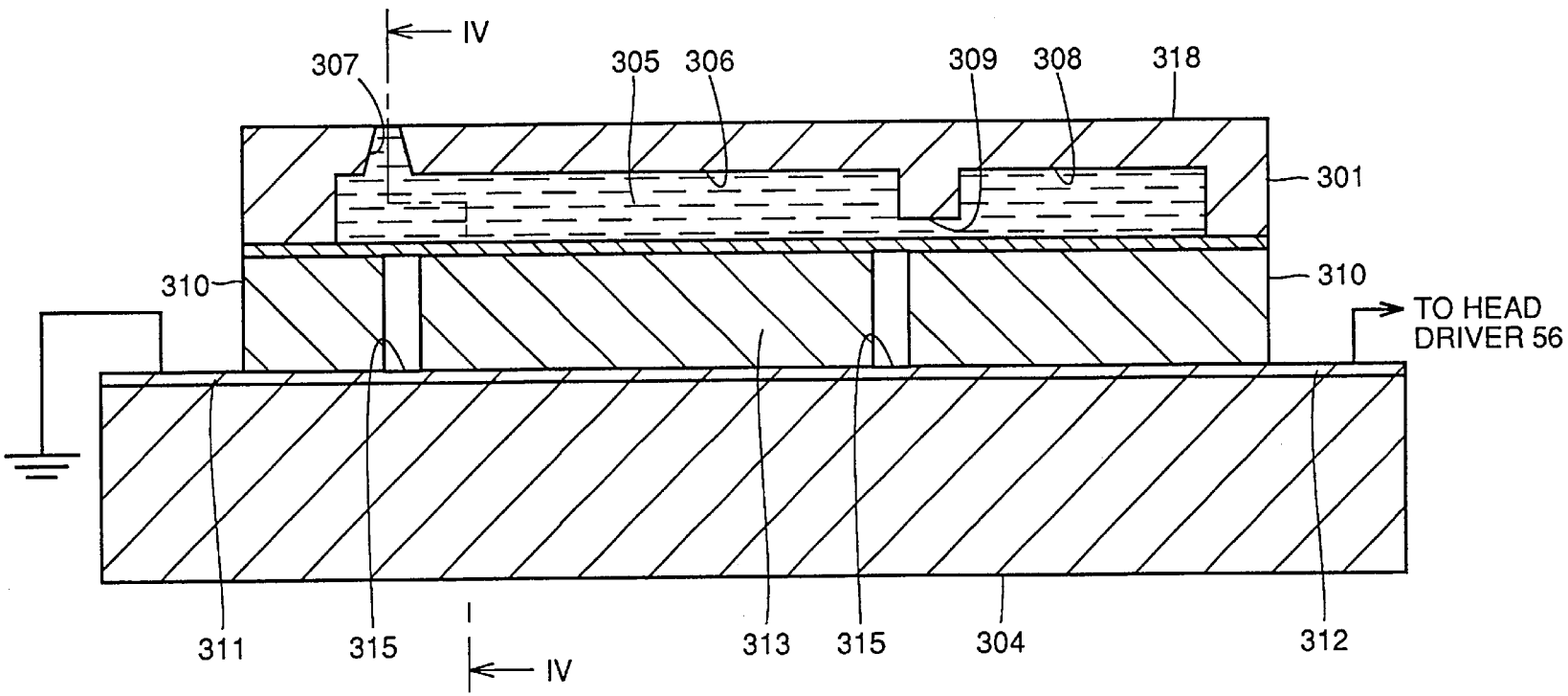
FIG. 3 is a cross sectional view for use in illustration of the structure of the printer head.
Figure 4:
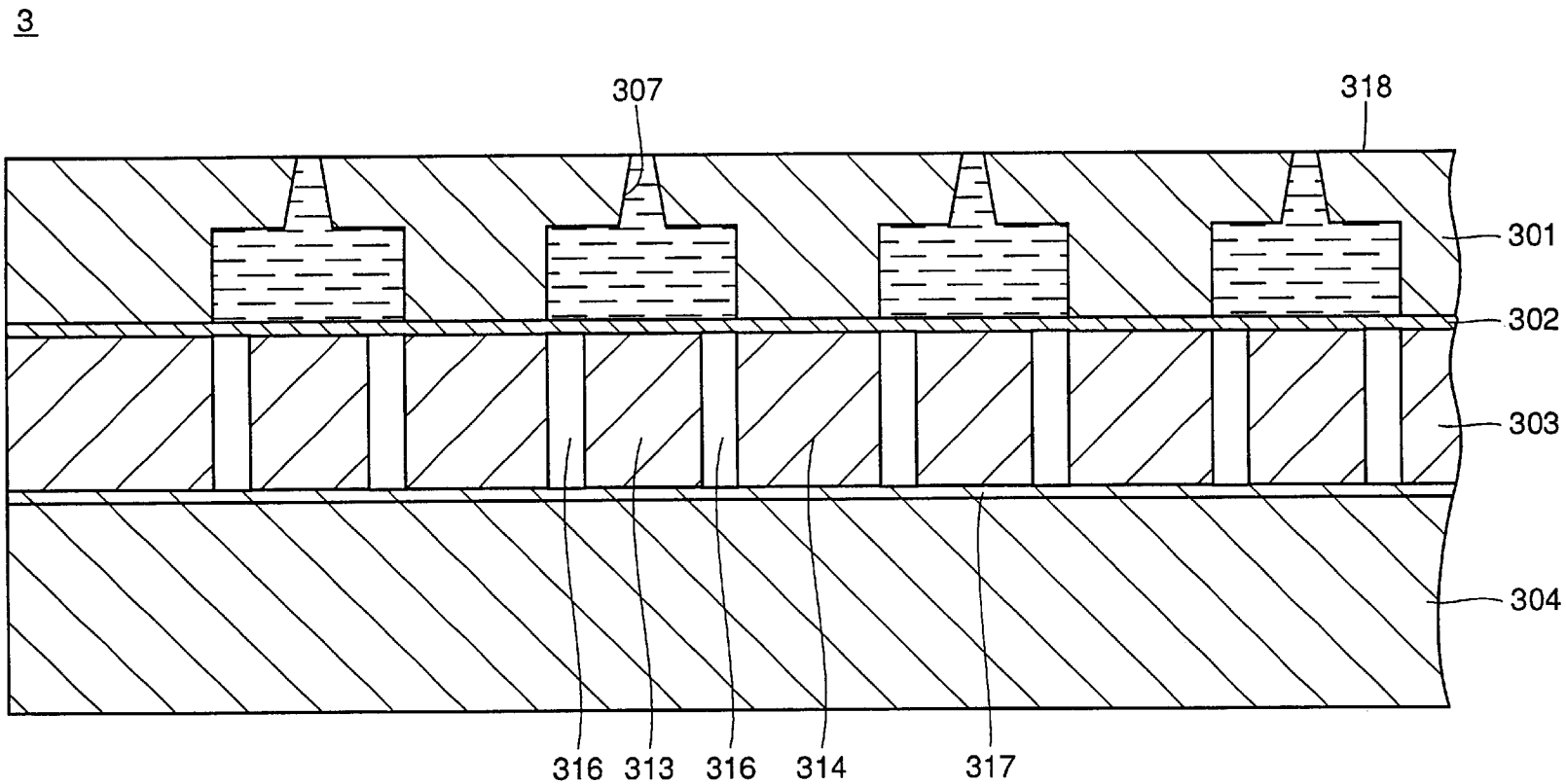
FIG. 4 is a cross sectional view for use in illustration of the structure of the printer head.

FIGS. 2 to 4 are views for use in illustration of the structure of printer head 3.

FIG. 2 is a plan view showing printer head 3, FIG. 3 a cross sectional view taken along line III—III in FIG. 2, and FIG. 4 a cross sectional view taken along line IV—IV in FIG. 3.

Printer head 3 is formed of a nozzle plate 301, a partitioning plate 302, a vibrating plate 303 and a substrate 304 which are integrally placed upon each other.

Nozzle plate 301 is formed of a metal or ceramics has nozzles 307, and an ion generating layer on its surface 318. Partitioning wall 302 of a thin film is fixed between nozzle plate 301 and vibrating plate 303.

Note that the direction in which nozzles 307 are arranged corresponds to the vertical scanning direction as described above, and printer head 3 is moved by carriage 4 in the horizontal scanning direction (the direction from the top to bottom in FIG. 2) perpendicular to the vertical scanning direction.

There are provided between nozzle plate 301 and partitioning plate 302, a plurality of ink channels 306 to accommodate ink 305, and an ink inlet 309 to couple each ink channel 306 to an ink supply chamber 308. Ink supply chamber 308 is connected to an ink tank which is not shown, and ink 305 in ink supply chamber 308 is supplied to ink channels 306.

Vibrating plate 303 includes a plurality of piezoelectric elements 313 corresponding to ink channels 306. Vibrating plates 303 is fixed to substrate 304 having an interconnection portion 317 with an insulation adhesive, and then separate grooves 315 and 316 are formed by dicer processing to segment vibrating plate 303. The segmentation also separates a piezoelectric element pillar portion 314 positioned between piezoelectric element 313 corresponding to ink channel 306 and an adjacent piezoelectric element 313 and a surrounding wall 310 from each other.

Interconnection portion 317 on substrate 304 has a common electrode side interconnection portion 311 connected to ground and commonly connected to all the piezoelectric elements 313 in printer head 3 and an individual electrode side interconnection portion 312 individually connected to each piezoelectric element 313 in printer head 3. Common electrode side interconnection portion 311 on substrate 304 is connected to a common electrode in piezoelectric element 313, while individual electrode side interconnection portion 312 is connected to an individual electrode in piezoelectric element 313.

The operation of such printer head 3 is controlled by the control unit of ink jet printer 1. The head driver 56 of the control unit (see FIGS. 5A and 5B) supplies a printing signal, i.e., prescribed voltage between the common electrode and the individual electrode provided in piezoelectric element 313, which deforms the element in the direction of pressing partitioning wall 302. The deformation of piezoelectric element 313 is transmitted to partitioning wall 302, which pressurizes ink 305 in ink channel 306, and an ink drop is expelled toward recording sheet 2 (see FIG. 1) through nozzle 307.

Figure 5A:
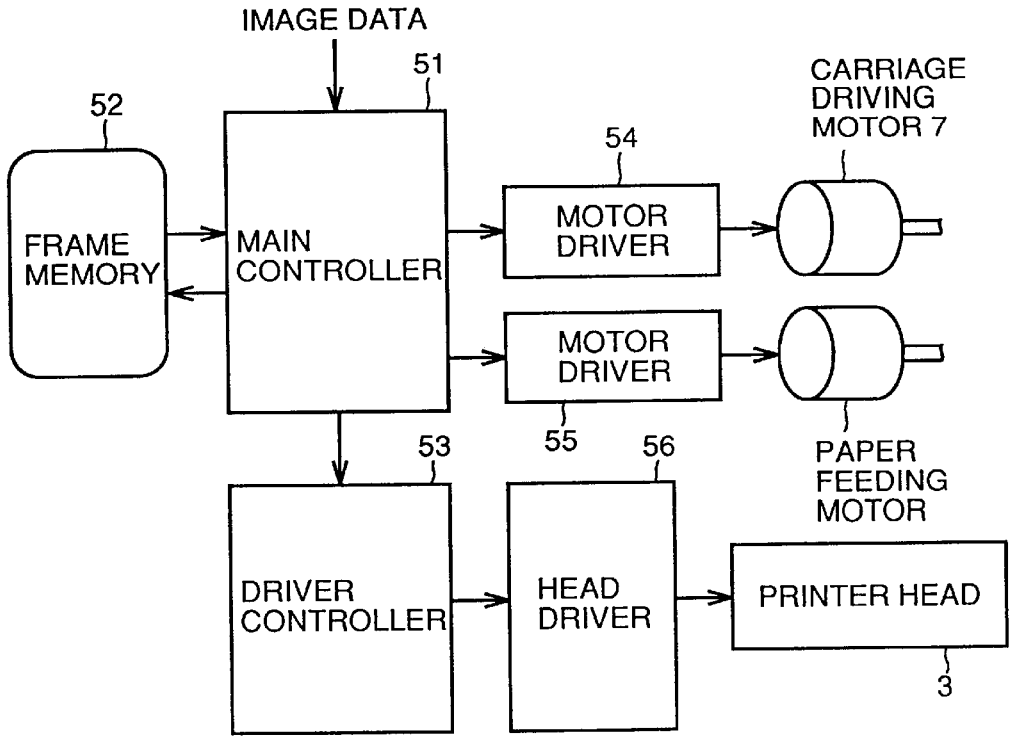
FIG. 5A and 5B are block diagrams showing the configurations of a control unit and a head driver in an ink jet printer.
Figure 5B:
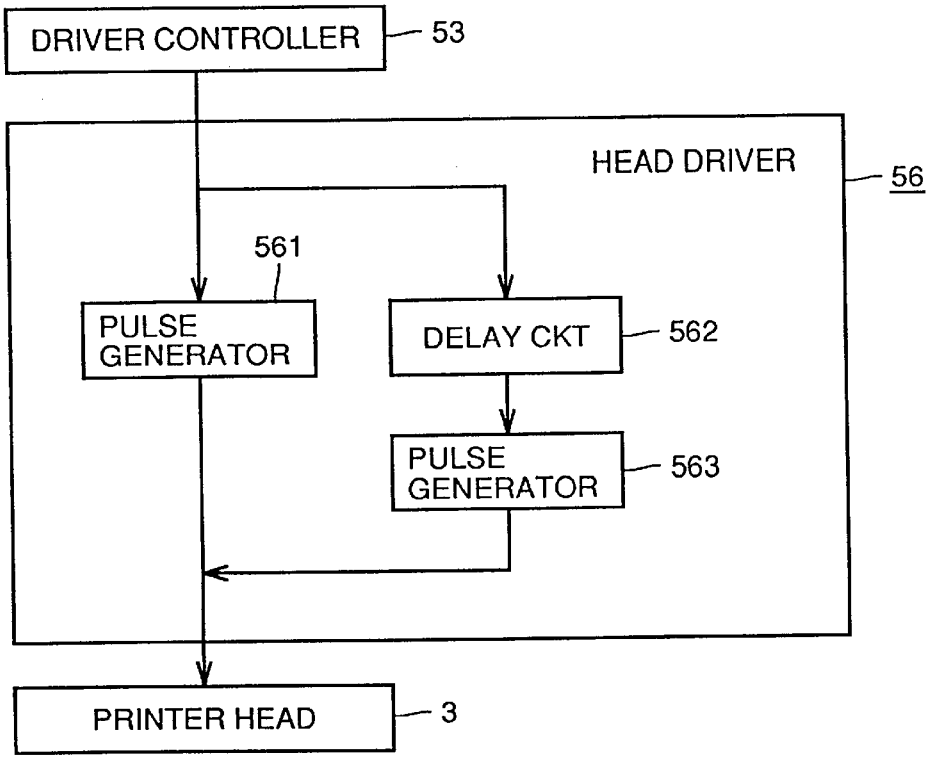

FIG. 5A is a block diagram showing the configuration of the control unit of ink jet printer 1, while FIG. 5B is a block diagram showing the configuration of head driver 56 in FIG. 5A.

As shown in FIG. 5A, the control unit mainly includes a main controller 51 formed of for example a one-chip microcomputer. Main controller 51 is connected to a frame memory 52, a driver controller 53 and motor drivers 54 and 55. Driver controller 53 is connected with printer head 3 through head driver 56. Meanwhile, motor drivers 54 and 55 are connected with driving motor 7 for moving the carriage and the driving motor for paper feeding, respectively.

Main controller 51 receives image data input from a computer or the like and makes the image data be stored on a 1-frame basis into frame memory 52 for buffer. At the time of printing onto recording sheet 2, main controller 51 controls driving motor 7 for moving the carriage and the driving motor for paper feeding through motor drivers 54 and 55. Main controller 51 controls the driving of the motors as described above and also reads out image data from frame memory 52 for supply to driver controller 53.

Driver controller 53 also has its operation timing controlled by main controller 51, and outputs a pulse signal to head driver 56 based on image data, in synchronization with the movement of recording sheet 2 and carriage 4.

Head driver 56 changes the pulse signal supplied from driver controller 53 into a signal to be actually supplied to printer head 3. More specifically, as shown in FIG. 5B, head driver 56 includes a pulse generator 561, a delay circuit 562, and a pulse generator 563, and the pulse signal from driver controller 53 is supplied to pulse generator 561 and delay circuit 562. Pulse generator 561 changes the waveform of the input pulse signal into a signal waveform to be actually supplied to piezoelectric element 313 in printer head 3. Delay circuit 562 delays the input pulse signal for a prescribed time period for supply to pulse generator 563. Pulse generator 563 changes the waveform of thus delayed and supplied pulse signal into a signal waveform to be actually supplied to piezoelectric element 313 in printer head 3.

In the configuration of the control unit, two driving pulse signals are supplied to printer head 3 based on single image data. They are the pulse signal (main pulse) generated by pulse generator 561, and the pulse signal (intermediate pulse) generated by delay circuit 562 and pulse generator 563.

Note that the delay time period of the pulse signal in delay circuit 562 as described above may be fixed or set using main controller 51.

In addition to these driving controls, main controller 51 controls the driving of each piezoelectric element 313 in printer head 3 through driver controller 53 and head driver 56 based on image data read out from frame memory 52.

(A) When a trapezoidal pulse waveform is used

Figure 6A:
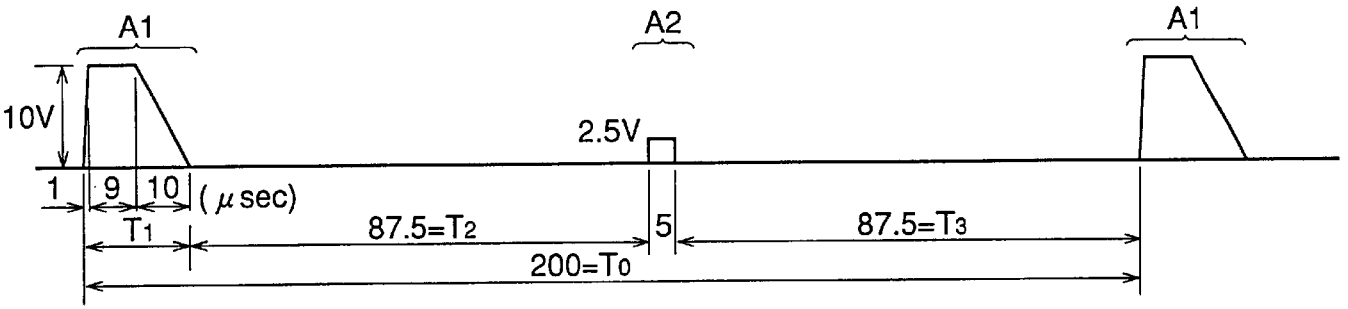
FIGS. 6A to 6C are waveform charts for use in illustration of the waveforms of pulse voltages to drive a piezoelectric element in the ink jet printer using trapezoidal waveforms.
Figure 6B:
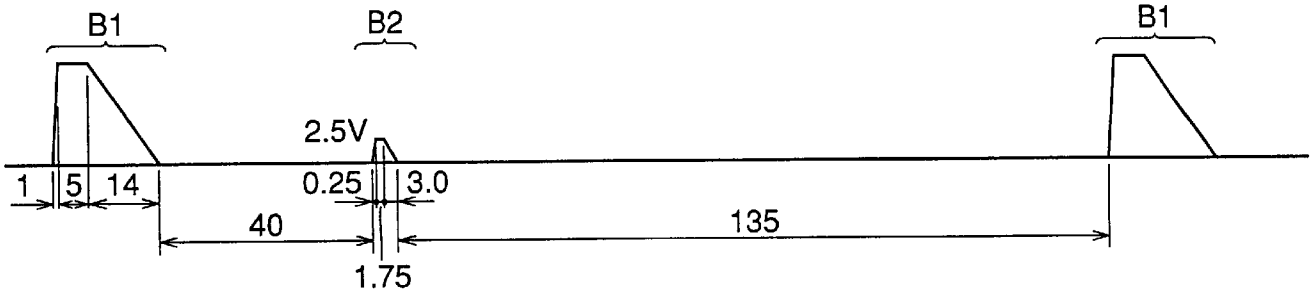
Figure 6C:
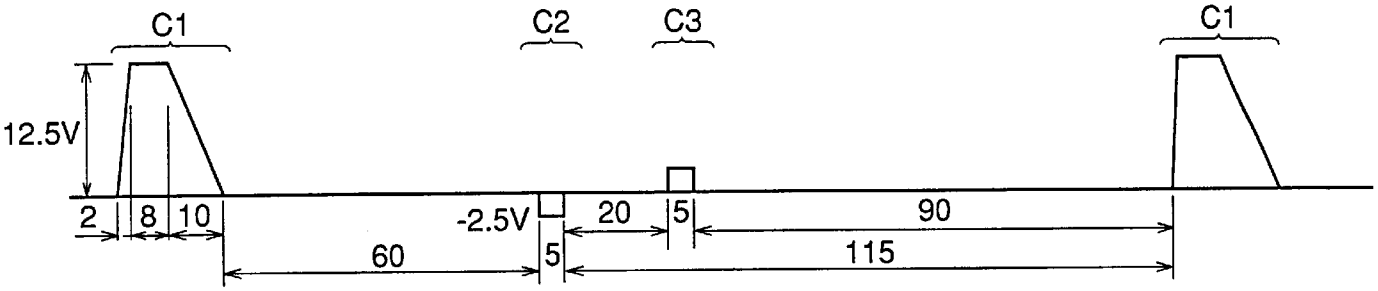

FIGS. 6A–6C are waveform charts for use in illustration of pulse voltage waveforms A to C to drive the piezoelectric element in the ink jet printer. FIG. 6A is a waveform chart showing pulse voltage waveform A to drive piezoelectric element 313 in the printer head 3 of ink jet printer of the first embodiment, FIG. 6B is a waveform chart showing pulse voltage waveform B to drive a piezoelectric element in a printer head in an ink jet printer according to a second embodiment, and FIG. 6C is a waveform chart showing pulse voltage waveform C to drive a piezoelectric element in a printer head 3 in an inkjet printer according to a third embodiment.

Note that a plurality of piezoelectric elements 313 are actually provided to printer head 3 in the vertical scanning direction, and these piezoelectric element 313 are individually provided with pulse voltage in various waveforms.

The configurations of the inkjet printers, printer heads and control unit according to the second and third embodiments are the same as those of the inkjet printer according to the first embodiment, and these pulse voltages are provided to piezoelectric elements in the printer head by the head driver as described above.

Waveform A includes a main pulse A1 applied to a piezoelectric element corresponding to a single ink drop, and an intermediate pulse A2 applied to the piezoelectric element between main pulse A1 and the next main pulse A1.

Main pulse A1 is raised from 0V to 10V in amplitude for a rising period of 1 μsec followed by the continuation of the amplitude for 9 μsec, and then made to fall from 10V to 0V in a falling time period of 10 μsec. The pulse width T1 of main pulse A1 is 20 μsec. Intermediate pulse A2 is raised form 0V to 2.5V in amplitude followed by the continuation of the amplitude for 5 μsec, and then made to fall from 2.5V to 0V.

The driving cycle between main pulse A1 and the next main pulse A1 is 200 μsec (i.e., the driving frequency is 5 kHz), and time period T2 since the falling of main pulse A1 until the rising of intermediate pulse A2 and time T3 since the falling of intermediate pulse A2 until the rising of the next main pulse A1 are both 87.5 μsec.

Waveform B includes a main pulse B1 applied to the piezoelectric element corresponding to a single ink drop, and an intermediate pulse B2 applied to the piezoelectric element between main pulse B1 and the next main pulse B1.

Main pulse B1 is raised from 0V to 10V in amplitude in a rising time period of 1 μsec, followed by the continuation of the amplitude for 5 μsec, and then made to fall from 10V to 0V in a falling time period of 14 μsec. The pulse width T1 of main pulse B1 is 20 μsec. Intermediate pulse B2 is raised from 0V to 2.5V in amplitude in a rising time period of 0.25 μsec, followed by the continuation of the amplitude for 1.75 μsec, and then made to fall from 2.5V to 0V in a falling time period of 3 μsec.

The driving cycle, in other words the time between main pulse B1 and the next main pulse B1 is 200 μsec (in other words the driving frequency is 5 kHz), and time period T2 since the falling of main pulse B1 until the rising of intermediate pulse B2 is 40 μsec, and time period T3 since the falling of intermediate pulse B2 until the rising of the next main pulse B1 is 135 μsec.

Waveform C includes a main pulse C1 applied to the piezoelectric element corresponding to a single ink drop, and intermediate pulses C2 and C3 applied to the piezoelectric element between main pulse C1 and the next main pulse C1.

Main pulse C1 is raised from 0V to 12.5V in a rising time period of 2 μsec, followed by the continuation of the amplitude for 8 μsec, and then made to fall from 12.5V to 0V in a falling time period of 10 μsec. The pulse width T1 of main pulse C1 is 20 μsec. Intermediate pulse C2 is lowered from 0V to −2.5V in amplitude, followed by the continuation of the amplitude for 5 μsec, and then made to raise from −2.5V to 0V. Intermediate pulse C3 is raised from 0V to 2.5V in amplitude, followed by the continuation of the amplitude for 5 μsec, and then made to fall from 2.5V to 0V.

The driving cycle, in other words the time period between main pulse C1 and the next main pulse C1 is 200 μsec (in other words the driving frequency is 5 kHz), time period T2 since the failing of main pulse C1 until the rising of intermediate pulse C2 is 60 μsec, the time period since the falling of intermediate pulse C2 until the rising of intermediate pulse C3 is 20 μsec, and time period T3 since the falling of intermediate pulse C3 until the rising of main pulse C1 is 90 μsec.

The timings for applying the intermediate pulses in waveforms A to C satisfy the following conditions (1) to (3):

$$T0<T3\geqq T2<T1 \quad (1)$$

$$T2\geqq 2\times T1 \quad (2)$$

$$T3\geqq 3\times T1 \quad (3)$$

wherein T0 is the time period since the start of application of the first main pulse voltage until the start of application of the second main pulse voltage, T1 is the pulse width (application time) of the first main pulse voltage, T2 is the time period since the end of application of the first main pulse voltage until the start of application of the intermediate voltage (group), and T3 is the time period since the end of application of the intermediate pulse voltage (group) until the start of application of the second main pulse voltage.

Now, the effects of waveforms A to C to drive the piezoelectric element described in conjunction with FIGS. 6A to 6C will be described.

Figure 7:
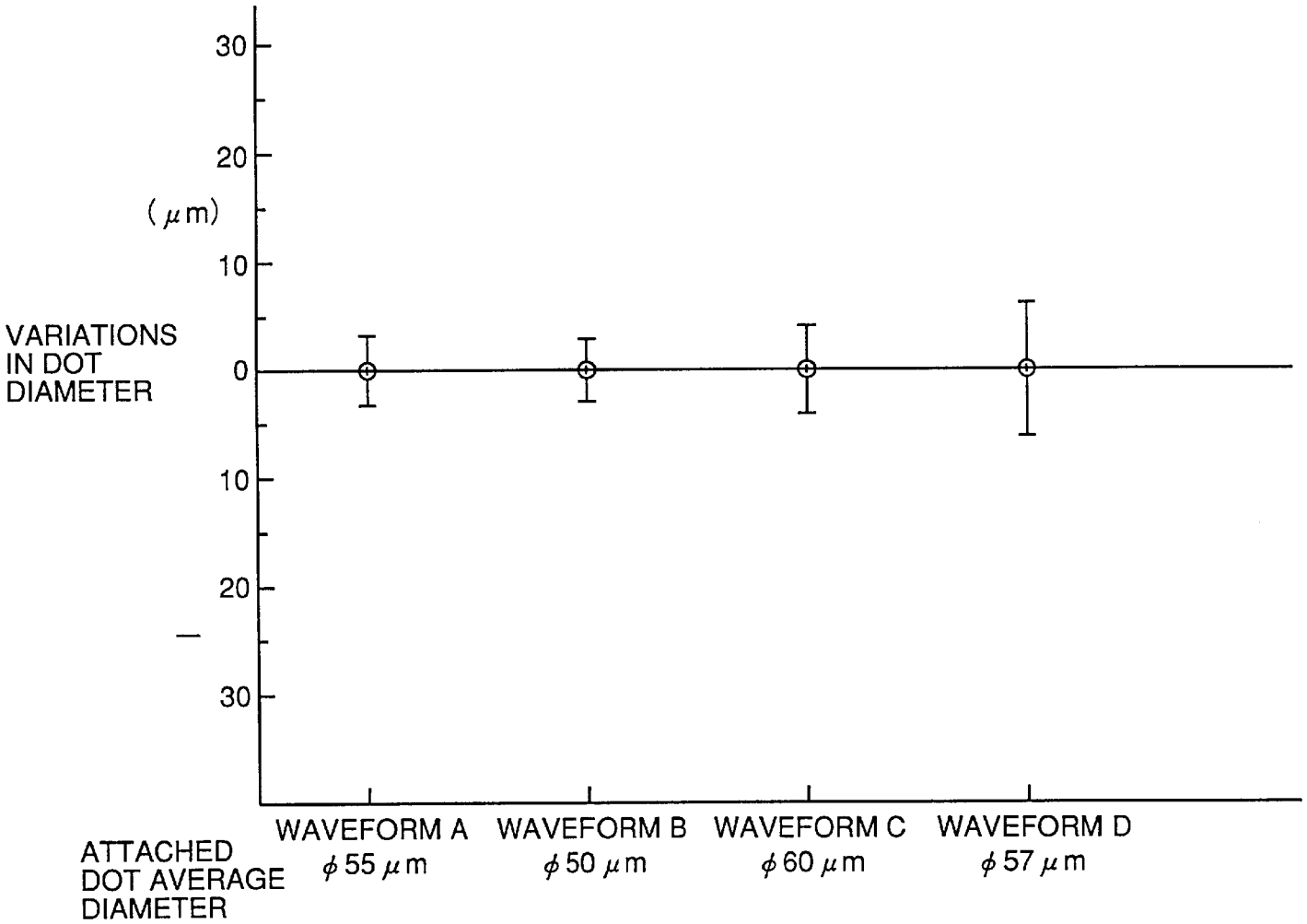
FIG. 7 is a graph for use in illustration of variations in size of printed dots using the trapezoidal waveforms A to D of the pulse voltages.

FIG. 7 is a graph for use in illustration of variations in the printed dot size using pulse voltage waveforms A to C in comparison with a conventional pulse voltage waveform D. Waveform D does not include the intermediate pulse of waveform A shown in FIG. 6A, and variations in the dot size printed by applying the pulse voltage of waveform D to the piezoelectric element is similarly given in FIG. 7.

These variations in printed characters were produced by measuring the size of 200 printed dots at a driving frequency of 5 kHz, only by changing the pulse voltage applied to the piezoelectric element while the other conditions such as printing sheet are the same. In FIG. 7, the mean value of the printed dot size is positioned in the center, and the width from the maximum value to the minimum value of the dot is given as differentials from the mean value of the dot size.

For waveform A, the average printed dot size was 55 $\mu$m, and the maximum and minimum differentials from the average value were both 3 $\mu$m. For waveform B, the average printed dot size was 50 $\mu$m, and the maximum and minimum differentials from the average value were both 3 $\mu$m. For waveform C, the average printed dot size was 60 $\mu$m, and the maximum and minimum differentials from the average value were both 4 $\mu$m. In comparison, for waveform D given as a comparison example, the average printed dot size was 57 $\mu$m, and the maximum and minimum differentials from the average value were both 7 $\mu$m.

During evaluating these variations in the printed dot size, a variation of ±5 $\mu$m or smaller usually would not cause any problem in the case of binary printing, but the variation of ±5 $\mu$m or greater could lead to gray level inversion during expressing the gray level by dots of various sizes. Therefore, when the dot size is controlled for gray level printing, the present invention provides significant advantage since each dot size is properly controlled.

A specific approach of controlling the dot size may be to change the waveform of a main pulse based on gray level data. In order to change the waveform, the voltage value of the main pulse may be changed or the pulse width of the main pulse may be changed. Furthermore, a sub pulse may be applied in addition to the main pulse for the purpose of controlling the dot size. Such a sub pulse may be applied immediately before or immediately after the application of the main pulse. In such a case, the main pulse, sub pulse and intermediate pulse as described above are applied to piezoelectric element 313.

In considering the advantage together with the results of measurement as described above, by applying an intermediate pulse which has an amplitude as small as 2V to 3V and does not independently cause an ink drop to be expelled only by itself, in the vicinity of the mid point of the cycle of the main pulse which drives the piezoelectric element and corresponds to a single printing dot such as waveforms A to C, the variations in printed dot size like that by waveform D may be restricted.

In particular, if conditions (1) to (3) are satisfied as for the timing to apply intermediate pulses, variations in the printed dot size may be more effectively restricted. However, as long as the wave generated in the ink in the ink channel may be prevented or reduced, the timing to apply the intermediate pulse is not limited to those which satisfy conditions (1) to (3).

In the above embodiments, the waveform of the main pulse was trapezoid, or the waveform of the intermediate pulse voltage was trapezoid or square for the purpose of illustration, pulse voltages are not limited to these waveforms, and the main pulse voltage or intermediate pulse voltage may have a triangular waveform.

(B) When a triangular or a sawtooth pulse waveform is used described above, each of the waveforms of the main pulse voltage and the intermediate pulse voltage may have a triangular shape or a sawtooth shape. In a case where the pulse voltage has such waveform, the pulse voltage does not contain a time period during which pulse amplitude is maintained constantly. Narrowed portions of ink pillar caused by such time period, therefore, are not produced, and the generation of satellites does not occur. Regarding the waveforms which do not contain such time period will be explained by referring the following embodiments.

Figure 8:
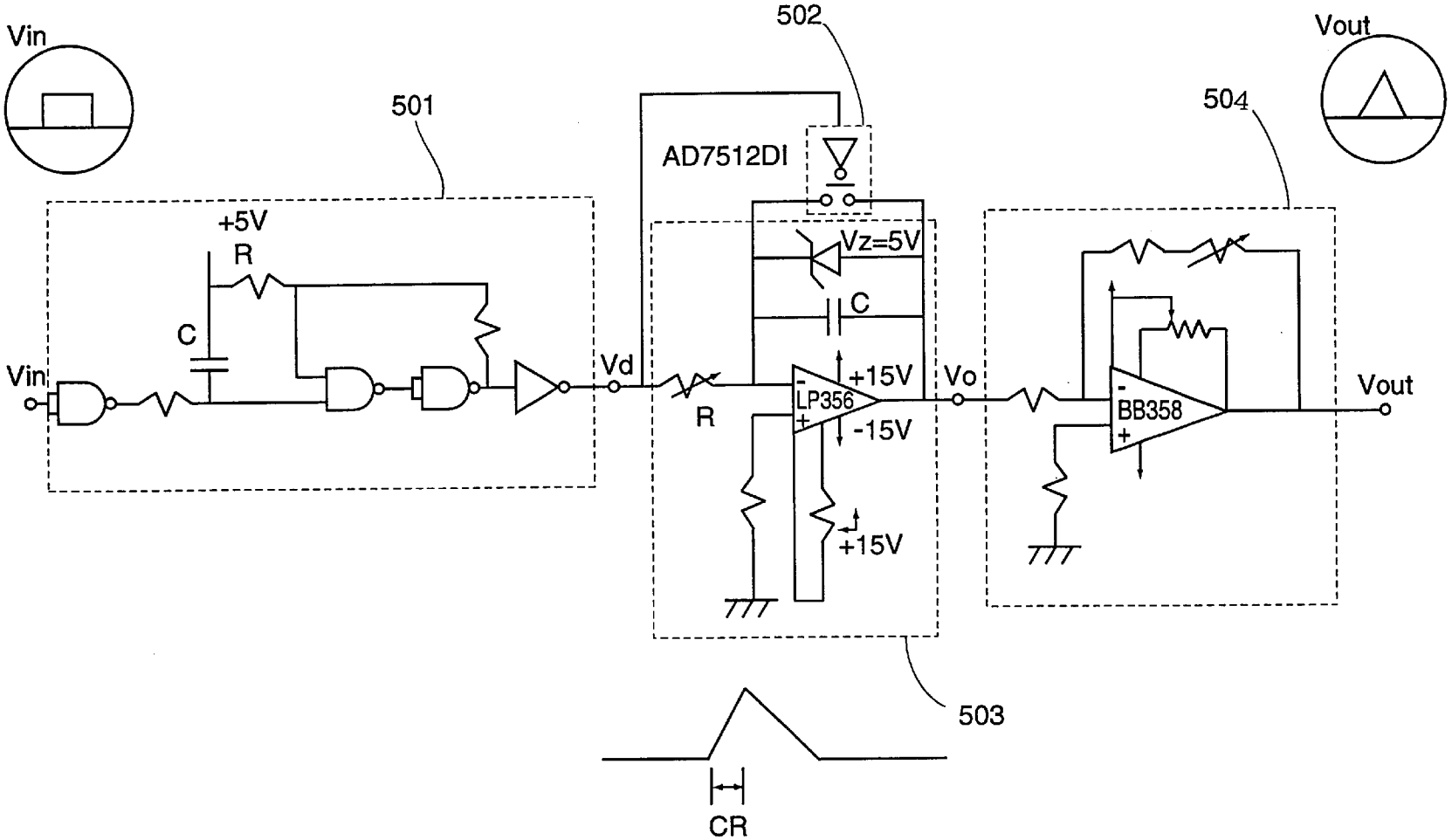
FIG. 8 is a diagram showing the configuration of a head driving portion.
Figure 9:
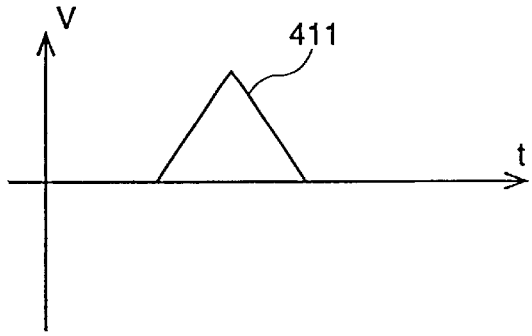
FIG. 9 is a waveform chart showing a triangular pulse voltage applied to a piezoelectric element by a head driver.

FIG. 8 is a diagram for use in illustration of the configuration of head driver 56 in the fourth embodiment, and FIG. 9 is a waveform chart showing the waveform 411 of a pulse voltage applied to the piezoelectric element by head driver 56 as shown in FIG. 8.

As shown in FIG. 8, head driver 56 includes a delay circuit 501, and a discharge circuit 502 including analog switch an inversion circuit 503 and an inversion amplification circuit 504 for triangular waveform.

An output signal Vout is produced from an input signal Vin according to an image signal by these circuits, and signal Vout is applied to the piezoelectric element for driving the element. Particularly, appropriately setting C and R in inversion circuit 503 determines the rising time (time constant=CR), which enables a desired triangular wave to be produced.

As shown in FIG. 9, the waveform 411 of the pulse voltage applied to the piezoelectric element in the inkjet printer according to this embodiment is a triangular wave consisting of a rising portion having a first inclination and a falling portion having a second inclination, unlike conventionally used rectangular pulse voltages. In the waveform 411 of the pulse voltage, time required for rising and falling is substantially equal.

Figure 10:
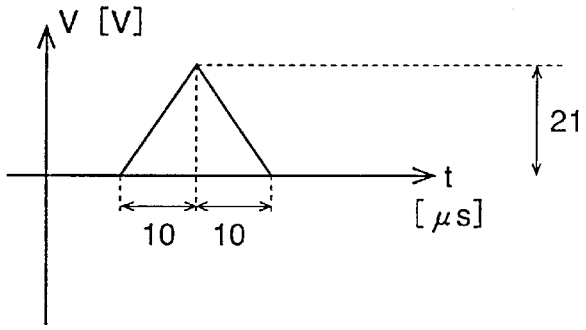
FIG. 10 is a waveform chair showing the waveform of a pulse voltage applied to a piezoelectric element in an inkjet printer according to an embodiment of the present invention.
Figure 11:
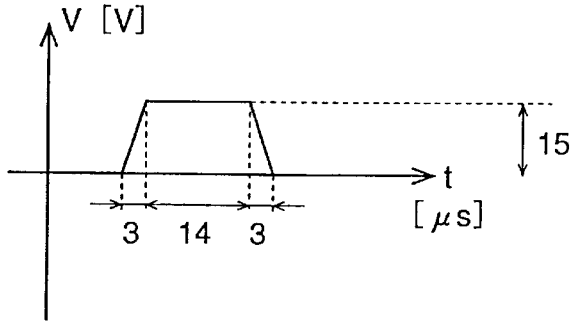
FIG. 11 PRIOR ART
FIG. 11 is a waveform chart showing the waveform of a pulse voltage conventionally applied to a piezoelectric element in an inkjet printer identical to the inkjet printer according to the present invention for illustrating the effects of applying a triangular wave.

The effects of applying such a triangular wave to the piezoelectric element will be now explained by experiments. FIGS. 10 and 11 are waveform charts showing experiments for demonstrating the effects of applying the triangular wave.

FIG. 10 is a chart showing the waveform 1 of pulse voltage applied to the piezoelectric element in the inkjet printer according to the fourth embodiment, and FIG. 11 is a chart showing the waveform 2 of a pulse voltage conventionally applied to a piezoelectric element in an inkjet printer identical to the inkjet printer according to the embodiment and used in the experiment. In this experiment, only the waveforms of the used voltages are different.

As shown in FIG. 10, pulse voltage waveform 1 is of a triangular wave that rises from 0V to 21V for a rising time period of 10 $\mu$s and falls from 21V to 0V for a falling time period of 10 $\mu$s. As shown in FIG. 11, pulse voltage waveform 2 is of a rectangular wave that rises from 0V to 15V for a rising time period of 3 $\mu$s, continues to have the amplitude for 14 $\mu$s and then falls from 15V to 0V for a falling time period of 3 $\mu$s.

In this experiment, in the inkjet printer as described above, ink dots expelled using two kinds of pulse voltages as shown in FIGS. 10 and 11 which allow the same average dot size to result are compared in connection with the generation of satellites and the dispersion of the dot sizes.

For the generation of satellites (satellite noises on a sheet), dots sticking to the sheet are viewed using a loupe for evaluation, and the dispersion of the dot sizes is evaluated by measuring dots sticking to the sheet.

Note that, in this embodiment, 200 dots are printed on a sheet by driving the piezoelectric element at 4 kHz. As the sheet, the "super fine paper" by Seiko Epson Corporation was used and as the ink, MAT-1002 by the DIC Corporation was used.

The result of the experiment under the conditions is given in the following Table 1.

TABLE 1

| | Average dot size | Satellite noises | Dispersion of dot sizes |
|---|---|---|---|
| Waveform 1 | 80 $\mu$m | none | 77 to 83 $\mu$m |
| Waverform 2 | 80 $\mu$m | present | 72 to 88 $\mu$m |

As can be seen from Table 1, the average dot size is 80 $\mu$m for both waveforms. In pulse voltage waveform 2 having an amplitude duration, satellite noises were observed and the dispersion of dot sizes is disadvantageously as wide as ±8 $\mu$m about the average dot size of 80 $\mu$m. Meanwhile, in the triangular pulse waveform 1, no satellite noise was generated, and the dispersion of the dot sizes is as good as ±3 $\mu$m about the average dot size of 80 $\mu$m.

Herein, a dispersion about as much as ±5 $\mu$m from the average dot size does not cause a problem in practice for binary printing, but the gradation could be reversed if multi-value printing is employed for expressing the gradation. In view of the possibility of such reversing of the gradation, a dispersion of ±5 or more is regarded as disadvantageous.

The result of these experiments shows that a pulse voltage of a triangular waveform applied to the piezoelectric element in the inkjet printer can prevent the generation of satellites and the instability of dot sizes associated with such satellites as conventionally experienced, and that the inkjet printer according to the present embodiment which applies a pulse voltage of a triangular waveform can improve the picture quality.

Referring to FIGS. 12 to 18, the waveforms of pulse voltages applied to piezoelectric elements in inkjet printers according to fifth to eleventh embodiments using a pulse voltage of triangular waveform will be described. The general configuration, the structures of the head and the control portion or the like are the same as those of the inkjet printer according to the foregoing embodiment.

Figure 12:
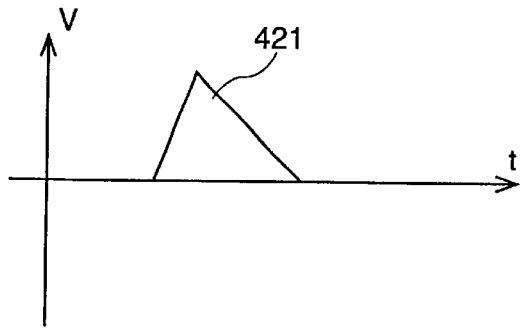
FIGS. 12 to 18 are waveform charts showing the waveforms of pulse voltages applied to piezoelectric elements in inkjet printers according to fifth to eleventh embodiments of the invention, respectively.

FIG. 12 is a waveform chart showing the waveform 421 of a pulse voltage applied to a piezoelectric element in an inkjet printer according to the fifth embodiment using a sawtooth pulse waveform. Pulse voltage waveform 421 is a triangular waveform consisting of a rising portion having a first inclination and a falling portion having a second inclination. The time required for rising is extremely shorter than the time required for falling, and the waveform is serrate. The use of pulse voltage waveform 421 prevents air from continuing to remain in the ink channel as compared to pulse voltage waveform 411.

The continuation of air will be detailed. When an ink channel 306 (see FIG. 3) is pressurized using a piezoelectric element 313, the pressure is divided to the side to a nozzle 307 and the side of an ink inlet 309, and a small amount of air is let in through nozzle 307 after expelling of ink, followed by the operation of supplying the next amount of ink.

If the driving frequency of the piezoelectric element is low, the supply of ink can follow sufficiently for expelling ink (printing), but the supply of ink could no longer follow if the driving frequency of the piezoelectric element is high. If the supply of ink cannot follow, bubbles remain inside ink channel 306, ink may not be expelled in some cases, since printing starts before the air (bubbles) is filled with ink.

Herein, by applying the pulse voltage of the serrated pulse voltage to the piezoelectric element, such residence of air is prevented.

Figure 13:
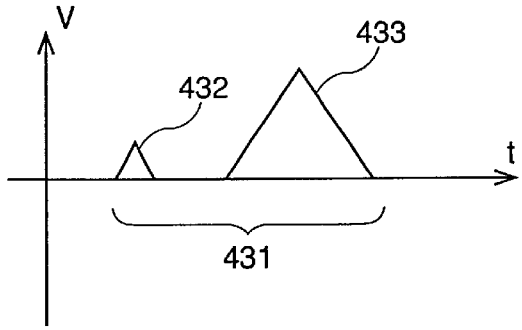

FIG. 13 is a waveform chart showing the waveform 431 of a pulse voltage applied to a piezoelectric element in an inkjet printer according to a sixth embodiment. Pulse voltage waveform 431 consists of a main pulse 433, and a pre-pulse 432 applied as a sub pulse immediately before main pulse 433 and having a smaller amplitude than the main pulse. The use of such pulse voltage waveform 431 improves supply of ink around nozzle 307 and the response of the piezoelectric element to the driving frequency, which improves the efficiency of expelling and prevents the residence of air compared with the case where the waveform 411 (FIG. 9) is used.

Figure 14:
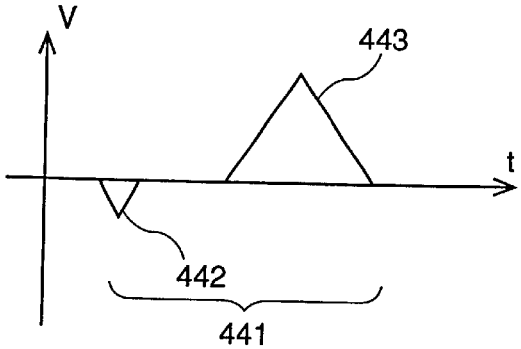

FIG. 14 is a waveform chart showing the waveform 441 of a pulse voltage applied to a piezoelectric element in an inkjet printer according to a seventh embodiment. Pulse voltage waveform 441 consists of a main pulse 443, and a pre-pulse 442 applied as a sub pulse to the piezoelectric element immediately before main pulse 443 and having an amplitude of the opposite polarity smaller than main pulse 443. the use of such pulse voltage waveform 441 improves the ink response and the efficiency of expelling as compared to pulse voltage waveform 411 (see FIG. 9), which prevents the residence of air, as is the case with pulse voltage waveform 431 rig. 3),.

Figure 15:
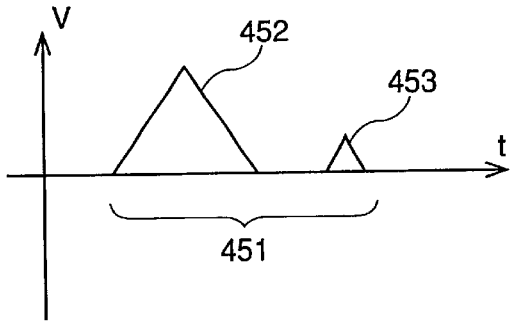

FIG. 15 is a waveform chart showing the waveform 451 of a pulse voltage applied to a piezoelectric element in an inkjet printer according to a eighth embodiment. Pulse voltage waveform 451 consists of a main pulse 452 and a post-pulse 453 applied as a sub pulse immediately after main pulse 452 and having an amplitude smaller than main pulse 452. The use of pulse voltage waveform 451 prevents the jiggle of ink in the ink channel after an amount of ink is expelled from the nozzle as compared to the case of using pulse voltage waveform 411 (see FIG. 9).

Figure 16:
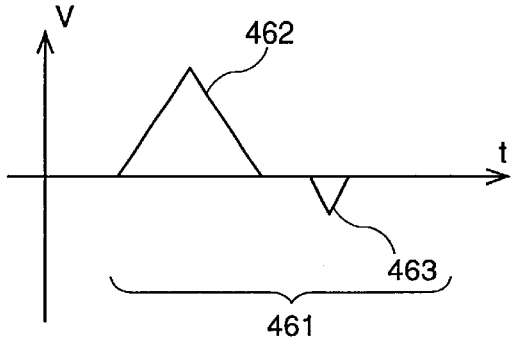

FIG. 16 is a waveform chart showing the waveform 461 of a pulse voltage applied to a piezoelectric element in an inkjet printer according to a ninth embodiment. Pulse voltage waveform 461 consists of a main pulse 462, and a post-pulse 463 applied as a sub pulse immediately after main pulse 462 and having an amplitude of the opposite polarity smaller than main pulse 462. The use of pulse voltage waveform 461 prevents the jiggle of ink in the channel after an amount of ink is expelled from the nozzle as compared to pulse voltage waveform 411 (see FIG. 9), as is the case with pulse voltage waveform 451 (see FIG. 15).

Figure 17:
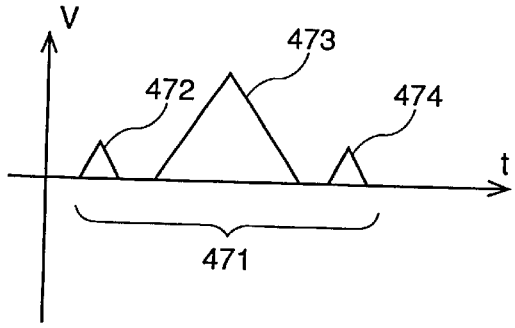

FIG. 17 is a waveform chart showing the waveform 471 of a pulse voltage applied to a piezoelectric element in an inkjet printer according to a tenth embodiment. Pulse voltage waveform 471 consists of a main pulse 473, a pre-pulse 472, and a post-pulse 474 as sub pulses. The use of pulse voltage waveform 471 having pre-pulse 472, and post-pulse 474 applied immediately before and after main pulse 473, respectively brings about the special effects of both pulse voltage waveforms 431 and 451 (see FIGS. 13 and 15), as is the case with pulse voltage waveform 471.

Figure 18:
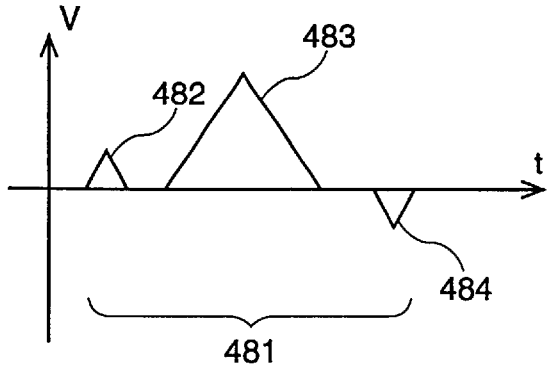
Figure 19:
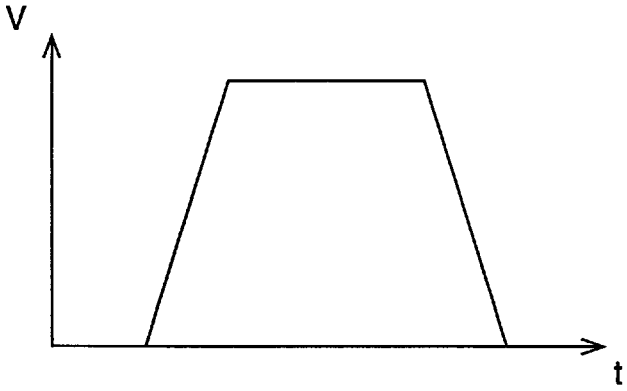
FIG. 19 PRIOR ART
FIG. 19 is a waveform chart showing a rectangular pulse voltage conventionally used.
Figure 20:
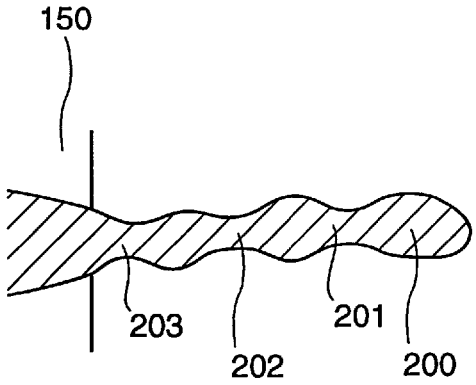
FIG. 20 PRIOR ART
FIG. 20 is an illustration showing narrowed parts of an expelled ink caused by the vibration of a piezoelectric element during a voltage hold period.
Figure 21:
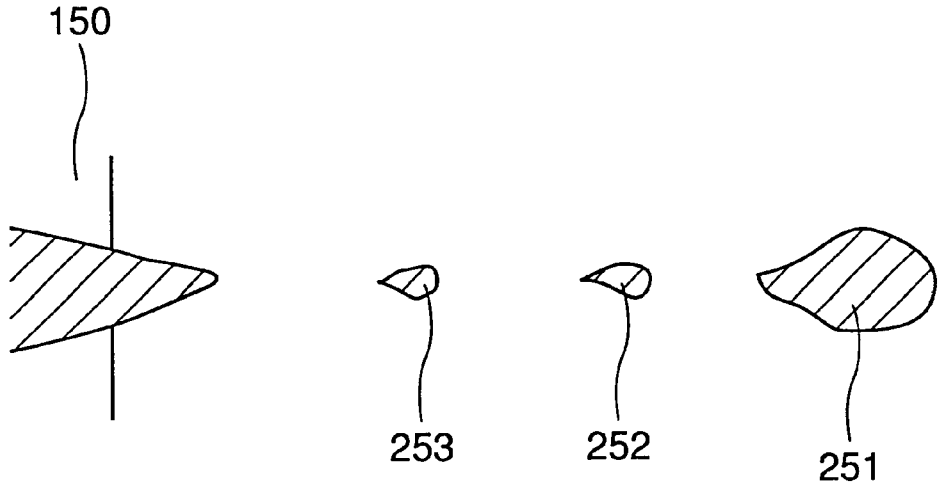
FIG. 21 PRIOR ART
FIG. 21 is an illustration showing ink droplets produced from the expelled ink having a narrowed part.

FIG. 18 is a waveform chart showing the waveform 481 of a pulse voltage applied to a piezoelectric element in an inkjet printer according to an eleventh embodiment. Pulse voltage waveform 481 consists of a main pulse 483, a pre-pulse 482, and a post-pulse 484 as sub pulses. The use of pulse voltage waveform 481 having pre-pulse 482 applied immediately before main pulse 483 and having a smaller amplitude of the same polarity, and post-pulse 484 applied immediately after main pulse 483 and having a smaller amplitude of the opposite polarity brings about the special effects of both pulse voltage waveforms 431 and 461 (see FIGS. 13 and 16), as is the case with pulse voltage waveform 471.

In the above embodiments, a pulse having a positive value is used as a main pulse, but a pulse having a negative value may be used depending upon the driving mode of the piezoelectric element, and the polarity of sub pulses (a pre-pulse and a post pulse) may be changed accordingly. Furthermore, the polarities of the pre-pulse, main pulse, and post-pulse may be arranged in various manners in particular in the inkjet printers according to the seventh and eighth embodiments.

When a triangular or sawtooth pulse waveform is used as described above, the triangular or sawtooth pulse voltage waveform applied to the piezoelectric elements in the inkjet printers according to the fourth to eleventh embodiments can prevent generation of satellite and the associated instability of the dot size, so that the picture quality may be improved. In addition, the use of the pre-pulse and post-pulse of the triangular or sawtooth pulse waveform brings about the above-described effects without a complex driver circuit.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. In an inkjet recording apparatus for expelling an ink droplet by using a piezoelectric element, a method for expelling the ink droplet comprising the steps of:

(a) outputting a drive pulse voltage from a driver to the piezoelectric element, the drive pulse voltage having a waveform consisting of a plurality of ramps, wherein a first energy is produced by the piezoelectric element in response to the drive pulse voltage such that an ink droplet is expelled from an ink channel in response to the first energy; and (b) outputting a supplemental pulse voltage from the driver to the piezoelectric element after the output of the drive pulse voltage is complete, wherein a second energy is produced by the piezoelectric element in response to the supplemental pulse voltage such that a reflected wave of ink in the ink channel is reduced in response to the second energy; and (c) repeating steps (a) and (b); and (d) outputting a second supplemental pulse voltage from the driver to the piezoelectric element before each step (a), wherein the second supplemental pulse voltage has a polarity which is the same as that of the drive pulse voltage.

2. In an inkjet recording apparatus for expelling an ink droplet by using a piezoelectric element, a method for expelling the ink droplet comprising the steps of:

(a) outputting a drive pulse voltage from a driver to the piezoelectric element, the drive pulse voltage having a waveform consisting of a plurality of ramps, wherein a first energy is produced by the piezoelectric element in response to the drive pulse voltage such that an ink droplet is expelled from an ink channel in response to the first energy; and (b) outputting a supplemental pulse voltage from the driver to the piezoelectric element after the output of the drive pulse voltage is complete, wherein a second energy is produced by the piezoelectric element in response to the supplemental pulse voltage such that a reflected wave of ink in the ink channel is reduced in response to the second energy; and (c) repeating steps (a) and (b); and (d) outputting a second supplemental pulse voltage from the driver to the piezoelectric element before each step (a), wherein the second supplemental pulse voltage has a waveform consisting of a plurality of ramps.

3. In an inkjet recording apparatus for expelling an ink droplet by using a piezoelectric element, a method for expelling the ink droplet comprising the steps of:

(a) outputting a drive pulse voltage from a driver to the piezoelectric element, the drive pulse voltage having a waveform consisting of a plurality of ramps, wherein a first energy is produced by the piezoelectric element in response to the drive pulse voltage such that an ink droplet is expelled from an ink channel in response to the first energy;

(b) outputting a supplemental pulse voltage from the driver to the piezoelectric element after the output of the drive pulse voltage is complete, wherein a second energy is produced by the piezoelectric element in response to the supplemental pulse voltage such that a reflected wave of ink in the ink channel is reduced in response to the second energy, wherein the supplemental pulse voltage has a polarity which is the same as that of the drive pulse voltage; and (c) repeating steps (a) and (b).

4. The method of claim 3, wherein the drive pulse waveform has a triangular shape.

5. The method of claim 3, wherein the drive pulse waveform has a sawtooth shape.

6. In an inkjet recording apparatus for expelling an ink droplet by using a piezoelectric element, a method for expelling the ink droplet comprising the steps of:

(a) outputting a drive pulse voltage from a driver to the piezoelectric element, the drive pulse voltage having a waveform consisting of a plurality of ramps, wherein a first energy is produced by the piezoelectric element in response to the drive pulse voltage such that an ink droplet is expelled from an ink channel in response to the first energy;

(b) outputting a supplemental pulse voltage from the driver to the piezoelectric element after the output of the drive pulse voltage is complete, wherein a second energy is produced by the piezoelectric element in response to the supplemental pulse voltage such that a reflected wave of ink in the ink channel is reduced in response to the second energy, wherein the supplemental pulse voltage has a waveform consisting of a plurality of ramps; and (c)repeating steps (a)and (b).

7. The method of claim 6, wherein the supplemental pulse voltage has a polarity which is opposite to that of the drive pulse voltage.

8. A driver for driving an inkjet head which expels an ink droplet filled in an ink channel in response to an energy produced by a piezoelectric element, the driver being adapted to output a first drive pulse voltage and a supplemental pulse voltage after the first drive pulse voltage is complete to the piezoelectric element, wherein the first drive pulse voltage is for producing the energy and has a waveform consisting of a plurality of ramps, wherein the supplemental pulse voltage is for reducing a reflected wave of ink in the ink channel so that the expulsion of another ink droplet is facilitated in response to a second drive pulse voltage subsequent to the completion of the supplemental pulse voltage, and wherein the driver further outputs a second supplemental pulse voltage to the piezoelectric element before the application of the first drive pulse voltage, wherein the second supplemental pulse voltage has a polarity which is the same as that of the first drive pulse voltage.

9. A driver for driving an inkjet head which expels an ink droplet filled in an ink channel in response to an energy produced by a piezoelectric element, the driver being adapted to output a first drive pulse voltage and a supplemental pulse voltage after the first drive pulse voltage is complete to the piezoelectric element, wherein the first drive pulse voltage is for producing the energy and has a waveform consisting of a plurality of ramps, wherein the supplemental pulse voltage is for reducing a reflected wave of ink in the ink channel so that the expulsion of another ink droplet is facilitated in response to a second drive pulse voltage subsequent to the completion of the supplemental pulse voltage, and wherein the driver further outputs a second supplemental pulse voltage to the piezoelectric element before the application of the first drive pulse voltage, wherein the second supplemental pulse voltage has a waveform consisting of a plurality of ramps.

10. A driver for driving an inkjet head which expels an ink droplet filled in an ink channel in response to an energy produced by a piezoelectric element, the driver being adapted to output a first drive pulse voltage and a supplemental pulse voltage after the first drive pulse voltage is complete to the piezoelectric element, wherein the first drive pulse voltage is for producing the energy and has a waveform consisting of a plurality of ramps, and wherein the supplemental pulse voltage is for reducing a reflected wave of ink in the ink channel so that the expulsion of another ink droplet is facilitated in response to a second drive pulse voltage subsequent to the completion of the supplemental pulse voltage, wherein the supplemental pulse voltage has a polarity which is the same as that of the first drive pulse voltage.

11. The driver of claim 10, wherein the first drive pulse waveform has a triangular shape.

12. The driver of claim 10, wherein the first drive pulse waveform has a sawtooth shape.

13. A driver for driving an inkjet head which expels an ink droplet filled in an ink channel in response to an energy produced by a piezoelectric element, the driver being adapted to output a first drive pulse voltage and a supplemental pulse voltage after the first drive pulse voltage is complete to the piezoelectric element, wherein the first drive pulse voltage is for producing the energy and has a waveform consisting of a plurality of ramps, and wherein the supplemental pulse voltage is for reducing a reflected wave of ink in the ink channel so that the expulsion of another ink droplet is facilitated in response to a second drive pulse voltage subsequent to the completion of the supplemental pulse voltage, wherein the supplemental pulse voltage has a waveform consisting of a plurality of ramps.

14. The driver of claim 13, wherein the supplemental pulse voltage has a polarity which is opposite to that of the first drive pulse voltage.

15. In an inkjet recording apparatus for expelling an ink droplet by using a piezoelectric element, a method for expelling the ink droplet comprising the steps of:

(a) outputting a drive pulse voltage from a driver to the piezoelectric element, the drive pulse voltage having a waveform consisting of a plurality of ramps, wherein a first energy is produced by the piezoelectric element in response to the drive pulse voltage such that an ink droplet is expelled from an ink channel in response to the first energy;

(b) outputting a supplemental pulse voltage from the driver to the piezoelectric element after the output of the drive pulse voltage is complete, wherein a second energy is produced by the piezoelectric element in response to the supplemental pulse voltage such that a reflected wave of ink in the ink channel is reduced in response to the second energy; and (c) repeating steps (a) and (b); and wherein the drive pulse voltage in step (a), the supplemental pulse voltage in step (b), and the drive pulse voltage in step (c) have a timing relationship expressed in the following formulas:

$$T0>T3\geqq T2>T1$$

$$T2\geqq 2\cdot T1, \text{ and}$$

$$T3\geqq 3\cdot T1$$

wherein

T0 is a first time period measured from a start of the drive pulse voltage in step (a) to a start of the drive pulse voltage in step (c),

T1 is a second time period measured as a pulse width of the drive pulse voltage in step (a),

T2 is a third time period measured from an end of the drive pulse voltage of step (a) to a start of the supplemental pulse voltage in step (b), and

T3 is a fourth time period measured from an end of the supplemental pulse voltage in step (b) to the start of the drive pulse voltage in step (c).

16. A driver for driving an inkjet head which expels an ink droplet filled in an ink channel in response to an energy produced by a piezoelectric element, the driver being adapted to output a first drive pulse voltage and a supplemental pulse voltage after the first drive pulse voltage is complete to the piezoelectric element, wherein the first drive pulse voltage is for producing the energy and has a waveform consisting of a plurality of ramps, wherein the supplemental pulse voltage is for reducing a reflected wave of ink in the ink channel so that the expulsion of another ink droplet is facilitated in response to a second drive pulse voltage subsequent to the completion of the supplemental pulse voltage, and wherein the first drive pulse voltage, the supplemental pulse voltage, and the second drive pulse voltage have a timing relationship expressed in the following formulas:

$$T0 > T3 \geqq T2 > T1$$

$$T2 \geqq 2 \cdot T1, \text{ and}$$

$$T3 \geqq 3 \cdot T1$$

wherein

T0 is a first time period measured from a start of the first drive pulse voltage to a start of the second drive pulse voltage,

T1 is a second time period measured as a pulse width of the first drive pulse voltage,

T2 is a third time period measured from an end of the first drive pulse voltage to a start of the next supplemental pulse voltage, and

T3 is a fourth time period measured from an end of the supplemental pulse voltage to the start of the second drive pulse voltage.

* * * * *